US010145339B1

(12) United States Patent
Werner et al.

(10) Patent No.: US 10,145,339 B1
(45) Date of Patent: Dec. 4, 2018

(54) SYSTEMS AND METHOD FOR A SELF DISABLING EJECTOR OF AN AIR INDUCTION SYSTEM

(71) Applicant: Ford Global Technologies, LLC, Dearborn, MI (US)

(72) Inventors: Matthew Werner, Marysville, MI (US); Scott Alan Bohr, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/709,345

(22) Filed: Sep. 19, 2017

(51) Int. Cl.
*F02M 25/08* (2006.01)
*F02M 35/10* (2006.01)

(52) U.S. Cl.
CPC .. *F02M 25/0872* (2013.01); *F02M 35/10091* (2013.01); *F02M 35/10222* (2013.01)

(58) Field of Classification Search
CPC ..... F02M 25/089; F02M 25/0872; F02M 35/10229; F02M 35/10236; F02M 35/10163
See application file for complete search history.

(56) References Cited

U.S. PATENT DOCUMENTS 9,243,595 B2 1/2016 Euliss et al.
9,528,473 B2 12/2016 Dudar et al.
9,885,323 B1 * 2/2018 Myers ..... F02M 25/0872
2014/0251284 A1 9/2014 Plymale et al.
2015/0275826 A1 10/2015 Balsdon et al.
2016/0305377 A1 * 10/2016 Stefaniak ..... F02M 35/10229
2016/0341155 A1 * 11/2016 Dudar ..... F02M 25/0836
2018/0087476 A1 * 3/2018 Amemiya ..... F02B 37/225
2018/0112634 A1 * 4/2018 Hoffman ..... F02M 35/10229

OTHER PUBLICATIONS

Myers, Christopher et al., "A Compact Ejector System for a Boosted Internal Combustion Engine," U.S. Appl. No. 15/225,920,filed Aug. 2, 2016, 34 pages.
Moyer, David et al., "Manufacture of a Compact Ejector System for a Boosted Internal Combustion Engine," U.S. Appl. No. 15/226,034, filed Aug. 2, 2016, 32 pages.
Hoffman, Steven et al., "Ejector Integrally Formed With an Intake Air Component and a Method to Manufacture," U.S. Appl. No. 15/333,208, filed Oct. 25, 2016, 27 pages.

* cited by examiner

*Primary Examiner* — Thomas Moulis
(74) *Attorney, Agent, or Firm* — Julia Voutyras; McCoy Russell LLP

(57) ABSTRACT

Methods and systems are provided for a self-disabling ejector of an air induction system and evaporative emissions systems. In one example, an ejector may include an outlet coupled to an inlet flow port of an air induction passage, upstream of a compressor, an evacuation port coupled to an external protrusion arranged adjacent to the inlet flow port on the air induction passage, a constriction arranged between the outlet and evacuation port, and first and second inlets positioned on either side of the constriction. If the outlet becomes disconnected from the inlet flow port, the evacuation port may disconnect from the external protrusion, thereby disabling the vacuum generating capabilities of the ejector.

20 Claims, 4 Drawing Sheets

SYSTEMS AND METHOD FOR A SELF DISABLING EJECTOR OF AN AIR INDUCTION SYSTEM

FIELD

The present description relates generally to methods and systems for a self-disabling ejector of an air induction system and evaporative emissions system of a vehicle.

BACKGROUND/SUMMARY

Vehicles may be fitted with evaporative emission systems such as onboard fuel vapor recovery systems. Such systems capture and prevent release of vaporized hydrocarbons to the atmosphere, for example fuel vapors generated in a vehicle gasoline tank during refueling. Specifically, the vaporized hydrocarbons (HCs) are stored in a fuel vapor canister packed with an adsorbent which adsorbs and stores the vapors. At a later time, when the engine is in operation, the evaporative emission control system allows the vapors to be purged into the engine intake manifold for use as fuel. The fuel vapor recovery system may include one more check valves, ejectors (or venturis), and/or controller actuatable valves for facilitating purge of stored vapors under boosted or non-boosted engine operation. Specifically, ejectors may be coupled to the air induction system of the engine and the evaporative emissions system in order to generate vacuum when the intake manifold of the engine is pressurized (e.g., boosted due to operation of a compressor) and enable purging of fuel vapors from the fuel vapor canister to the air induction system. However, if such ejectors develop a leak or if one or more hoses or ducting coupled to the ejector becomes degraded, it may be possible for gases containing fuel vapors to escape to the atmosphere. Thus, these ejectors must either be diagnosable for correct operation (and prevention of fuel vapor leakage to the atmosphere) or the ejector nozzle must be located inside the air induction system. However, the inventors herein have recognized that positioning the ejector nozzle inside the air induction system limits engine packaging and increases costs.

Some approaches diagnose and detect leaks in ejector system components adjacent to the ejector inlets and/or upstream of the ejector inlets. For example, using a variety of sensors in an engine system, leaks may be detected in hoses, conduits, or ductwork coupled to the inlet of the ejector or at other locations in an ejector system upstream of the ejector outlet. However, such approaches fail to diagnose or detect leaks in an ejector system at or downstream of the ejector outlet. For example, a hose or other ducting may be used to couple the outlet of an ejector to an engine intake at a position upstream of a compressor. If such a hose degrades, or decouples from the ejector outlet, the resulting leak in the ejector system may remain undetected leading to increased emissions and degradation in engine operation.

Other attempts to address detecting ejector leaks and preventing fuel vapors from escaping to the atmosphere include hard-mounting the ejector to the air induction system and/or including one or more shut-off valves in the ejector. One example approach is shown by Euliss et al. in U.S. Pat. No. 9,243,595. Therein, an outlet of the ejector may be either hard-mounted to the air induction system or include one or more shut-off valves. The ejector may also include at least one break-point at the constriction or inlets of the ejector. Ejector failure at the break-points directs leaks away from the outlet to the inlets, where they may be detected without additional sensors or logic.

However, the inventors herein have recognized potential issues with such systems. As one example, hard-mounting the outlet to the air induction system may not result in a clear, detectable leak if the outlet connection becomes degraded or partially disconnected. Additionally, including one or more break-points may be complicated to implement, thereby increasing manufacturing costs of the ejector and/or still resulting in fuel vapor leakage to the atmosphere.

In one example, the issues described above may be addressed by a system, comprising: an air induction passage of an engine including an inlet flow port and an external protrusion having a closed end, each branching off a same side of the air induction passage; and an ejector, including: a constriction arranged between an outlet adapted to couple to the inlet flow port and an evacuation port adapted to couple to the protrusion; and first and second inlets positioned on either side of the constriction. In one example, the first inlet is coupled to an intake manifold of the engine, the second inlet is coupled to a fuel vapor canister of an evaporative emissions systems, and the outlet is coupled to the air induction passage, upstream of a compressor. During engine operation, if the outlet becomes uncoupled from the inlet flow port, the evacuation port may also become uncoupled from the external protrusion. As a result, the external protrusion will no longer block flow from exiting the ejector via the evacuation port and gases (e.g., compressed intake air from the intake manifold) flowing through the ejector will exit via the evacuation port before passing through the constriction. This may disable the vacuum generation at the constriction, thereby preventing fuel vapors from being pulled into the ejector via the second inlet. As a result, fuel vapors may not escape the ejector via the disconnected outlet of the ejector. In this way, the ejector may self-disable when becoming disconnected from the air induction system, thereby reducing the leakage of fuel vapors into the atmosphere. Further, by providing a self-disabling ejector, costly valve components and monitoring systems for detecting a disconnected ejector are not needed, thereby reducing engine control complexity and costs.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1A:
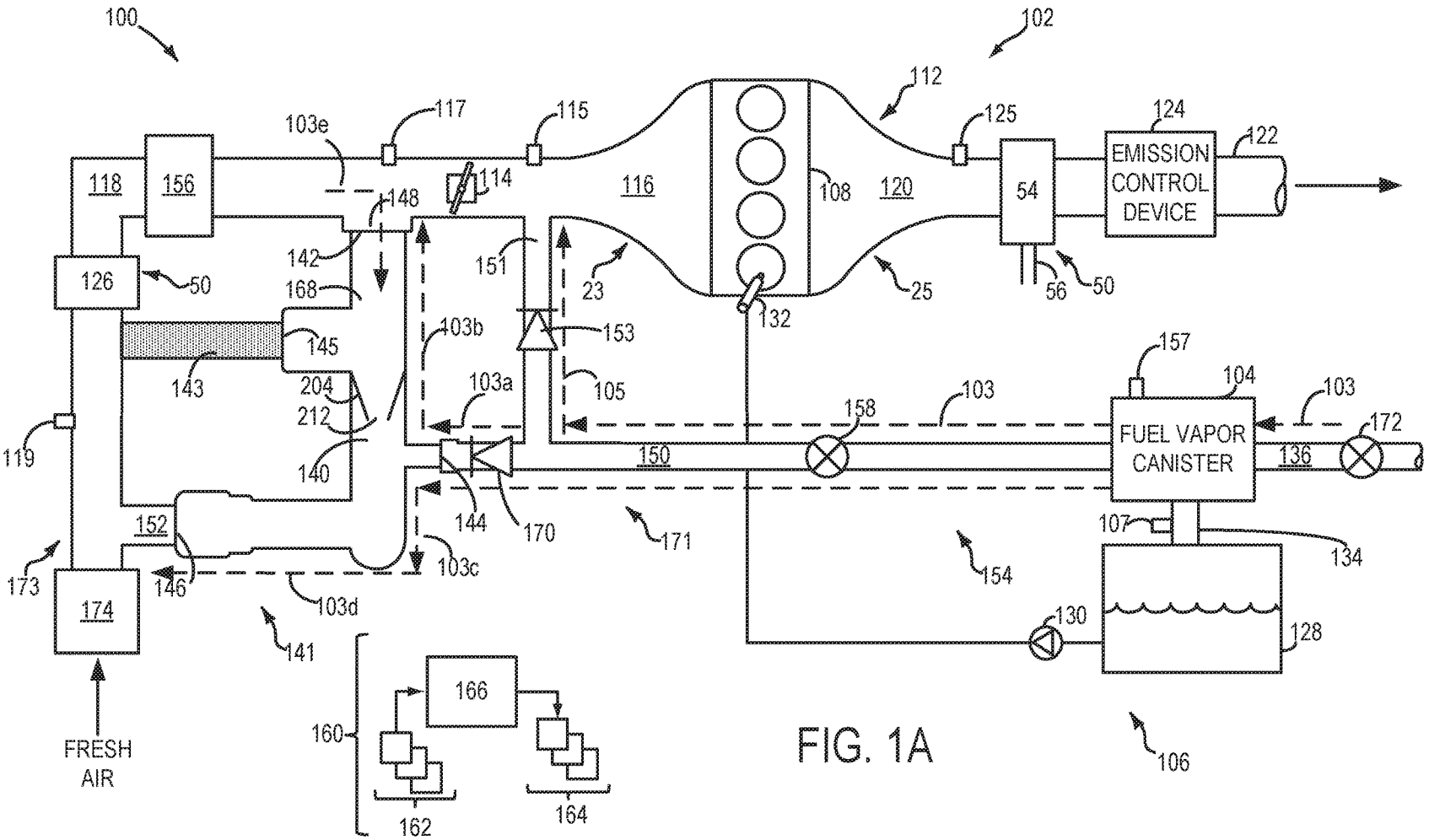
FIG. 1A shows a schematic diagram of a fuel vapor recovery system of a vehicle system with a dual path ejector system connected to the air induction system (AIS).
Figure 1B:
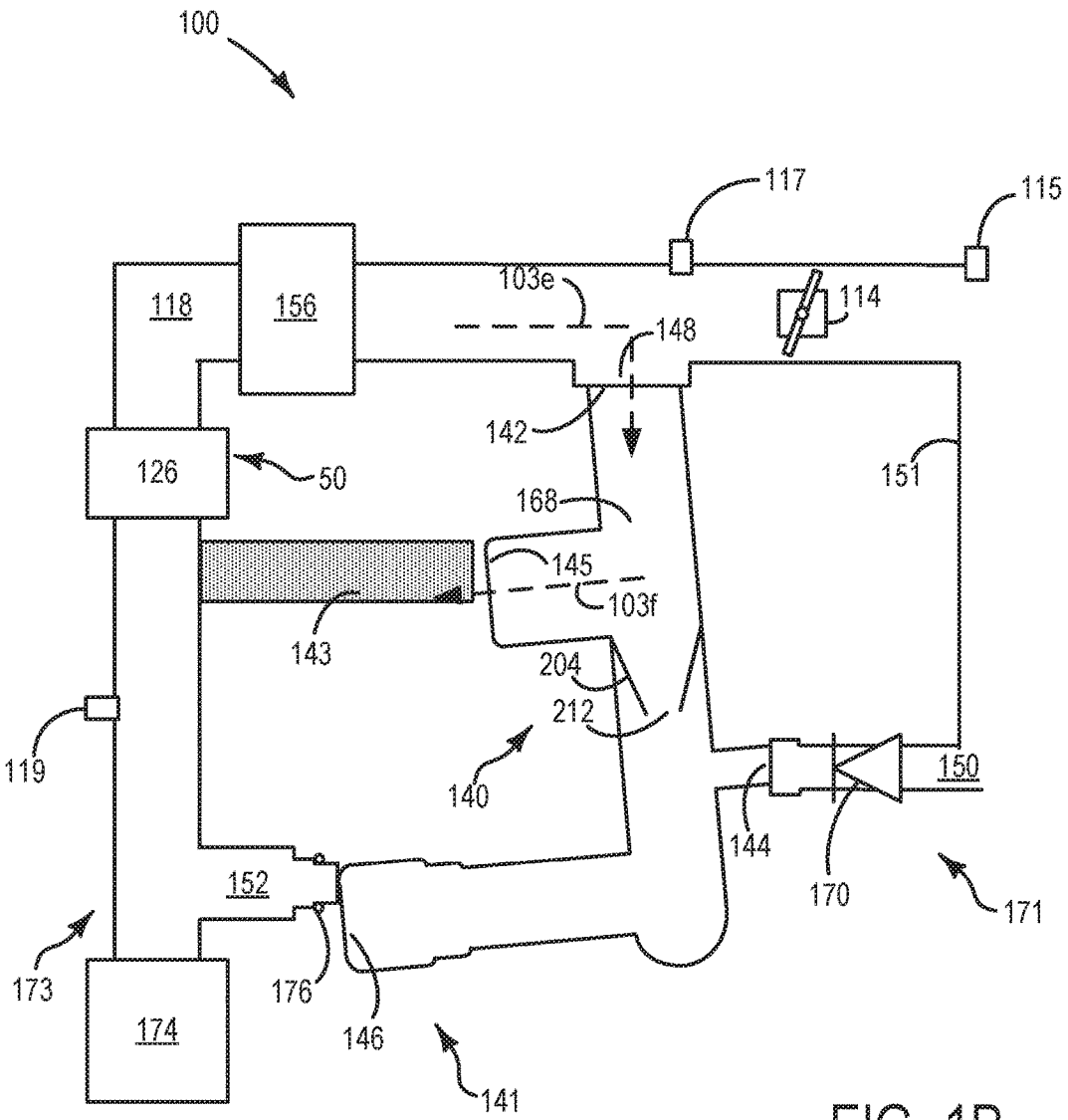
FIG. 1B shows a schematic diagram of the ejector system disconnected from the air induction system (AIS).
Figure 2A:
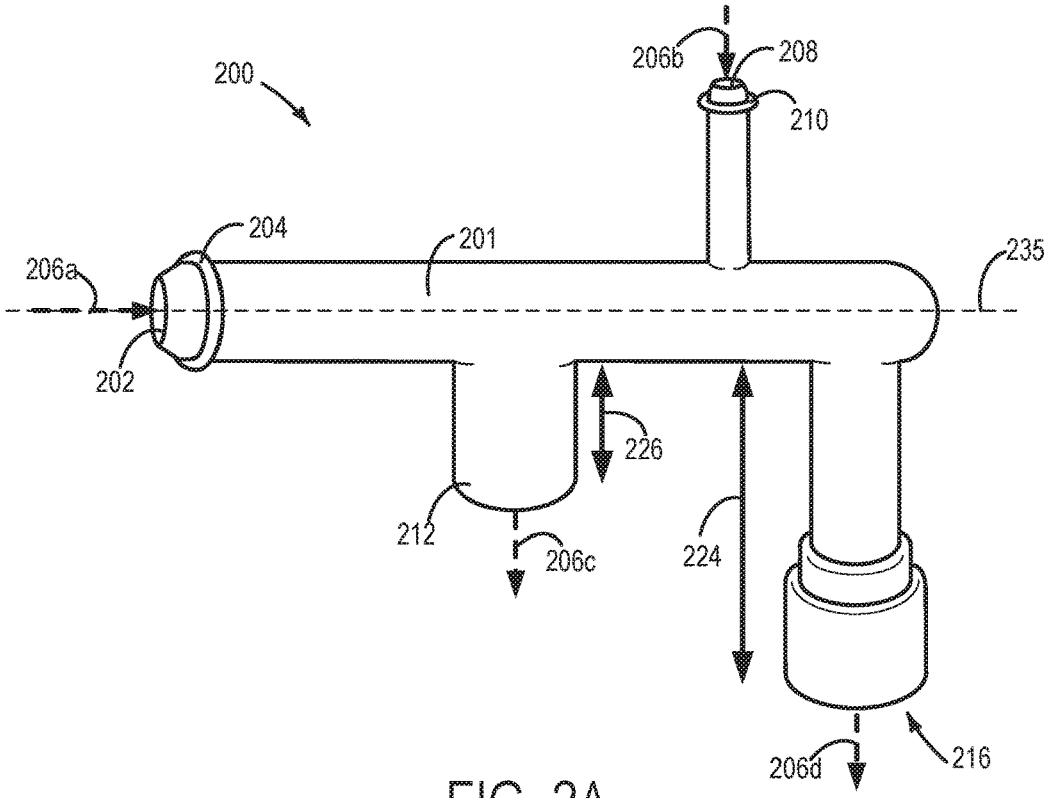
FIG. 2A illustrates an exterior, front view of a first embodiment of a dual path ejector system.
Figure 2B:
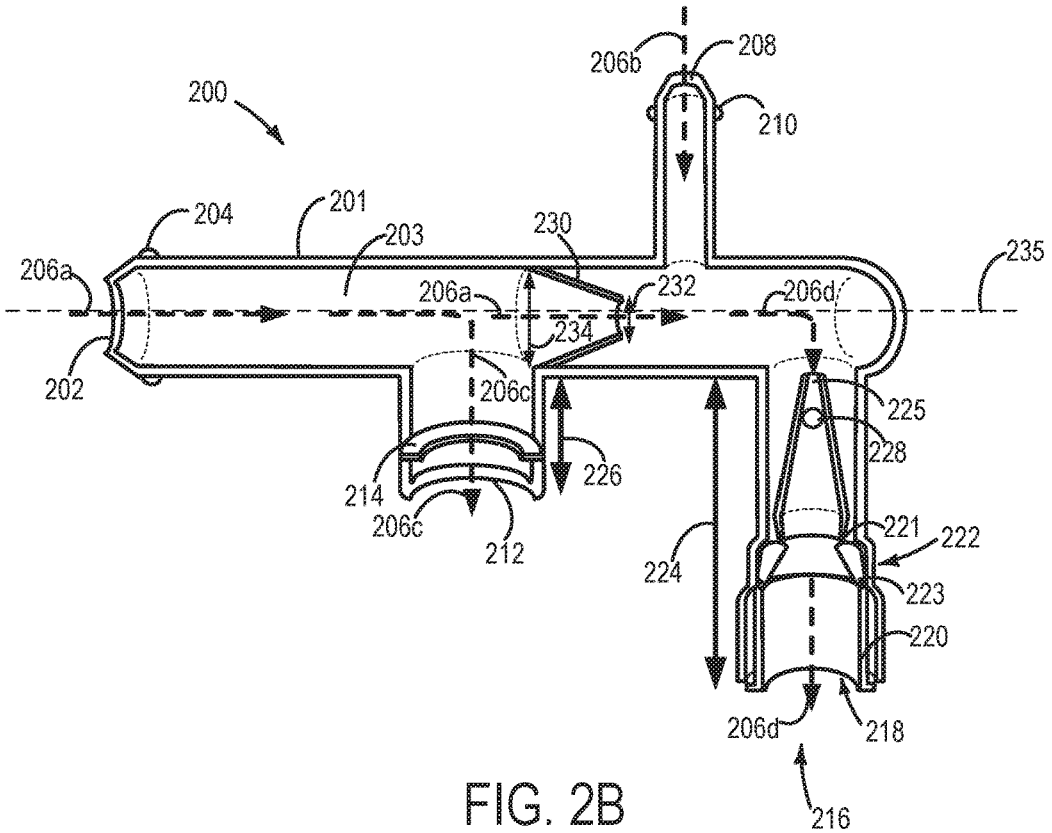
FIG. 2B illustrates a cut-away view of an interior of the first embodiment of the dual path ejector system.

The following description relates to systems and methods for diagnosing leaks in a dual path purge system including an ejector, in an engine system, such as the example vehicle system shown in FIG. 1 and for disabling fuel vapor flow from an evaporative emissions system of the engine and through the ejector when the ejector becomes disconnected from an air induction system of the engine. As described above, leaks, e.g. leaks due to stresses to the ejector and/or degradation in ejector system components such as hoses or ducting, may be diagnosed and detected in system components at or upstream of inlets to the ejectors. In order to diagnose and perform mitigating actions in response to leaks present downstream of an ejector outlet, e.g., between the ejector and an air induction system (AIS), a self-disabling ejector system may be directly latched to the AIS and configured to detach in the case of a broken port or disconnected ejector. The ejector includes an inner constriction, e.g. a venturi nozzle, as well as a large port prior to the venture nozzle as depicted in FIGS. 2A-2B, and is adapted to couple to the AIS at an outlet downstream of the venturi nozzle. As shown in FIG. 1B and described in the method presented at FIG. 3, if the ejector system is disabled, boosted air from the engine will escape the system via an evacuation port in the ejector and reduce or stop vacuum formation at the venturi nozzle, thereby preventing fuel vapors from entering the atmosphere via the ejector and enabling detection of the fault in the ejector system.

Turning now to the figures, FIGS. 1A-1B shows a schematic depiction of a vehicle system 100. Specifically, FIG. 1A shows a more detailed view of the vehicle system 100 where an ejector 140 is connected to an air induction system 173. FIG. 1B shows a zoomed-in view of the ejector 140 and air induction system 173, where the ejector 140 is disconnected from a portion of the air induction system 173 arranged upstream of a compressor 126. As shown in FIG. 1A, the vehicle system 100 includes an engine system 102 coupled to a fuel vapor recovery system (evaporative emissions control system) 154 and a fuel system 106. The engine system 102 may include an engine 112 having a plurality of cylinders 108. The engine 112 includes an engine intake 23 and an engine exhaust 25. The engine intake 23 includes a throttle 114 fluidly coupled to the engine intake manifold 116 via an intake passage 118. An air filter 174 is positioned upstream of throttle 114 in intake passage 118. The engine exhaust 25 includes an exhaust manifold 120 leading to an exhaust passage 122 that routes exhaust gas to the atmosphere. The engine exhaust 122 may include one or more emission control devices 124, which may be mounted in a close-coupled position in the exhaust. One or more emission control devices may include a three-way catalyst, lean NOx trap, diesel particulate filter, oxidation catalyst, etc. It will be appreciated that other components may be included in the vehicle system, such as a variety of valves and sensors, as further elaborated below.

Throttle 114 may be located in intake passage 118 downstream of a compressor 126 of a boosting device, such as turbocharger 50, or a supercharger and a charge air cooler 156. Compressor 126 of turbocharger 50 may be arranged between air filter 174 and charge air cooler 156 in intake passage 118. Compressor 126 may be at least partially powered by exhaust turbine 54, arranged between exhaust manifold 120 and emission control device 124 in exhaust passage 122. Compressor 126 may be coupled to exhaust turbine 54 via shaft 56. Compressor 126 may be configured to draw in intake air at atmospheric air pressure into an air induction system (AIS) 173 and boost it to a higher pressure. Using the boosted intake air, a boosted engine operation may be performed.

An amount of boost may be controlled, at least in part, by controlling an amount of exhaust gas directed through exhaust turbine 54. In one example, when a larger amount of boost is requested, a larger amount of exhaust gases may be directed through the turbine. Alternatively, for example when a smaller amount of boost is requested, some or all of the exhaust gas may bypass turbine via a turbine bypass passage as controlled by wastegate (not shown). An amount of boost may additionally or optionally be controlled by controlling an amount of intake air directed through compressor 126. Controller 166 may adjust an amount of intake air that is drawn through compressor 126 by adjusting the position of a compressor bypass valve (not shown). In one example, when a larger amount of boost is requested, a smaller amount of intake air may be directed through the compressor bypass passage.

Fuel system 106 may include a fuel tank 128 coupled to a fuel pump system 130. The fuel pump system 130 may include one or more pumps for pressurizing fuel delivered to fuel injectors 132 of engine 112. While only a single fuel injector 132 is shown, additional injectors may be provided for each cylinder. For example, engine 112 may be a direct injection gasoline engine and additional injectors may be provided for each cylinder. It will be appreciated that fuel system 106 may be a return-less fuel system, a return fuel system, or various other types of fuel system. In some examples, a fuel pump may be configured to draw the tank's liquid from the tank bottom. Vapors generated in fuel system 106 may be routed to fuel vapor recovery system (evaporative emissions control system) 154, described further below, via conduit 134, before being purged to the engine intake 23.

Fuel vapor recovery system 154 includes a fuel vapor retaining device, depicted herein as fuel vapor canister 104. Canister 104 may be filled with an adsorbent capable of binding large quantities of vaporized HCs. In one example, the adsorbent used is activated charcoal. Canister 104 may receive fuel vapors from fuel tank 128 through conduit 134. While the depicted example shows a single canister, it will be appreciated that in alternate embodiments, a plurality of such canisters may be connected together. Canister 104 may communicate with the atmosphere through vent 136. In some examples, a canister vent valve 172 may be located along vent 136, coupled between the fuel vapor canister and the atmosphere, and may adjust a flow of air and vapors between canister 104 and the atmosphere. However, in other examples, a canister vent valve may not be included. In one example, operation of canister vent valve 172 may be regulated by a canister vent solenoid (not shown). For example, based on whether the canister is to be purged or not, the canister vent valve may be opened or closed. In some examples, an evaporative level check monitor (ELCM) (not shown) may be disposed in vent 136 and may be configured to control venting and/or assist in detection of undesired evaporative emissions. Furthermore, in some examples, one or more oxygen sensors may be positioned in the engine intake 116, or coupled to the canister 104 (e.g., downstream of the canister), to provide an estimate of canister load. In still further examples, one or more temperature sensors 157 may be coupled to and/or within canister 104. As will be discussed in further detail below, as fuel vapor is adsorbed by the adsorbent in the canister, heat is generated (heat of adsorption). Likewise, as fuel vapor is desorbed by the adsorbent in the canister, heat is consumed. In this way, the adsorption and desorption of fuel vapor by the canister may be monitored and estimated based on temperature changes within the canister, and may be used to estimate canister load.

Conduit 134 may optionally include a fuel tank isolation valve (not shown). Among other functions, fuel tank isolation valve may allow the fuel vapor canister 104 to be maintained at a low pressure or vacuum without increasing the fuel evaporation rate from the tank (which would otherwise occur if the fuel tank pressure were lowered). The fuel tank 128 may hold a plurality of fuel blends, including fuel with a range of alcohol concentrations, such as various gasoline-ethanol blends, including E10, E85, gasoline, etc., and combinations thereof.

Fuel vapor recovery system 154 may include a purge system 171. Purge system 171 is coupled to canister 104 via a conduit 150. Conduit 150 may include a canister purge valve (CPV) 158 disposed therein. Specifically, CPV 158 may regulate the flow of vapors along duct 150. The quantity and rate of vapors released by CPV 158 may be determined by the duty cycle of an associated CPV solenoid (not shown). In one example, the duty cycle of the CPV solenoid may be determined by controller 166 responsive to engine operating conditions, including, for example, an air-fuel ratio. By commanding the CPV to be closed, the controller may seal the fuel vapor canister from the fuel vapor purging system, such that no vapors are purged via the fuel vapor purging system. In contrast, by commanding the CPV to be open, the controller may enable the fuel vapor purging system to purge vapors from the fuel vapor canister.

Fuel vapor canister 104 operates to store vaporized hydrocarbons (HCs) from fuel system 106. Under some operating conditions, such as during refueling, fuel vapors present in the fuel tank may be displaced when liquid is added to the tank. The displaced air and/or fuel vapors may be routed from the fuel tank 128 to the fuel vapor canister 104, and then to the atmosphere through vent 136. In this way, an increased amount of vaporized HCs may be stored in fuel vapor canister 104. During a later engine operation, the stored vapors may be released back into the incoming air charge via fuel vapor purging system 171.

Conduit 150 is coupled to an ejector 140 in a purge system 141 and includes a second check valve (CV2) 170 disposed therein between ejector 140 and CPV 158. Second check valve (CV2) 170 may prevent intake air from flowing through from the ejector into conduit 150, while allowing flow of air and fuel vapors from conduit 150 into ejector 140. CV2 170 may be a vacuum-actuated check valve, for example, that opens responsive to vacuum derived from ejector 140.

A conduit 151 couples conduit 150 to intake 23 at a position within conduit 150 between check valve 170 and CPV 158 and at a position in intake 23 downstream of throttle 114. For example, conduit 151 may be used to direct fuel vapors from canister 104 to intake 23 using vacuum generated in intake manifold 116 during a purge event. Conduit 151 may include a first check valve (CV1) 153 disposed therein. First check valve (CV1) 153 may prevent intake air from flowing through from intake manifold 116 into conduit 150, while allowing flow of fluid and fuel vapors from conduit 150 into intake manifold 116 via conduit 151 during a canister purging event. CV1 may be a vacuum actuated check valve, for example, that opens responsive to vacuum derived from intake manifold 116.

An outlet port 148 in intake 23 may be coupled to ejector 140 at a first inlet 142 positioned upstream of a nozzle 204 within ejector 140. Ejector 140 includes a second inlet 144 arranged downstream of nozzle 204, coupling ejector 140 to conduit 150. Ejector 140 is coupled to intake 23 at a position upstream of throttle 114 and downstream of charge air cooler 156 via outlet port 148. During boost conditions, compressed air may be directed through intake conduit 118 downstream of compressor 126 into ejector 140 via outlet port 148 and inlet 142, as indicated by an arrow 103*e*.

Ejector 140 may also be coupled to intake conduit 118 at a position upstream of compressor 126 via a conduit 152. Conduit 152 is coupled at a first end directly to air induction system 173 along conduit 118 at a position between air filter 174 and compressor 126. At a second end, conduit 152 is connected to an outlet 146 of ejector 140. Conduit 152 may be part of and/or an inlet (e.g., inlet flow port) into the intake conduit 118 of the air induction system 173. Outlet (e.g., outlet port) 146 is positioned perpendicular to inlet (e.g., inlet port) 142, parallel to inlet (e.g. inlet port) 144, and is a rigid extension on an opposite side of ejector 140 from inlet 144. Outlet 146 may be connected (e.g., coupled) to conduit 152 via a fitting such as a quick connect fitting. For example, the inner orifice of outlet 146 may include a first quick connect fitting, e.g. a female quick connect port. As shown in FIG. 1B, a second quick connect port 176, e.g. a male quick connect port, may be attached to or part of the second end of conduit 152, including a mating feature (e.g., ball bearings) adapted to lock quick connect port 176 within the female quick connect fitting of outlet 146 when surrounded by and positioned within the inner walls of the female quick connect coupled to outlet 146. In this way, conduit 152 may be removably coupled to outlet 146 of ejector 140. An example of the female quick connect fitting is shown in FIG. 2B and will be described further below.

As seen in FIGS. 1A-1B, ejector 140 includes an evacuation port 145 that is positioned downstream of inlet 142, and upstream of the nozzle 204, inlet 144, and outlet 146. Evacuation port is parallel to outlet 146 and is also a rigid extension on the same side of ejector 140 as outlet 146. An opening of evacuation port 145 is coupled to a first end of a protrusion (e.g., plug) 143. Protrusion 143 is fixed at a second end to an outer wall of intake conduit 118, branching off the AIS on a same side as conduit 152 (inlet flow port), on the same side of intake conduit 118 as conduit 152, downstream of and parallel to conduit 152 and upstream from compressor 126. Protrusion 143 is arranged outside of the AIS 173 and may be either a solid cylinder or closed at the first end that is adapted to prevent flow between air outside of ejector 140 and air inside of ejector 140 via evacuation port 145. For example, a rubber seal or o-ring may be disposed within interior of evacuation port 145, as illustrated in FIG. 2B, wherein the o-ring accommodates insertion of the first end of protrusion 143 and seals around and against an outer wall of protrusion 143.

Ejector 140 includes a housing 168 coupled to inlets 142 and 144, outlet 146, and evacuation port 145. In one example, only the inlets 142 and 144, outlet 146, and evacuation port 145 are included in ejector 140. Ejector 140 may include various check valves disposed therein. For example, in some examples, ejector 140 may include a check valve positioned adjacent to each inlet and outlet in ejector 140 so that unidirectional flow of fluid or air is present at each inlet and outlet. For example, air from intake conduit 118 downstream of compressor 126 may be directed into ejector 140 via inlet 142 and may flow through the ejector and exit the ejector at outlet 146 before being directed into intake conduit 118 at a position upstream of compressor 126. This flow of air through the ejector may create a vacuum due to the Venturi effect at inlet 144 so that vacuum is provided to conduit 150 via inlet 144 during boosted operating conditions. In particular, a low pressure region is created adjacent to inlet port 144 which may be used to draw purge vapors from the canister into ejector 140.

Ejector 140 includes nozzle 204 comprising an orifice which converges in a direction from inlet 142 toward suction inlet 144 so that when air flows through ejector 140 in a direction from inlet 142 towards outlet 146, a vacuum is created at inlet 144 due to the Venturi effect. This vacuum may be used to assist in fuel vapor purging during certain conditions, e.g., during boosted engine conditions. In one example, ejector 140 is a passive component. That is, ejector 140 is designed to provide vacuum to the fuel vapor purge system via conduit 150 to assist in purging under various conditions, without being actively controlled. Thus, whereas CPV 158 and throttle 114 may be controlled via controller 166, for example, ejector 140 may be neither controlled via controller 166 nor subject to any other active control. In another example, the ejector may be actively controlled with a variable geometry to adjust an amount of vacuum provided by the ejector to the fuel vapor recovery system via conduit 150.

During select engine and/or vehicle operating conditions, such as after an emission control device light-off temperature has been attained (e.g., a threshold temperature reached after warming up from ambient temperature) and with the engine running, the controller 166 may adjust the duty cycle of a canister vent valve solenoid (not shown) and open or maintain open canister vent valve 172. For example, canister vent valve 172 may remain open except during vacuum tests performed on the system (described in further detail below). At the same time, controller 12 may adjust the duty cycle of the CPV solenoid (not shown) and open CPV 158. Pressures within fuel vapor purging system 171 may then draw fresh air through vent 136, fuel vapor canister 104, and CPV 158 such that fuel vapors flow into conduit 150.

The operation of ejector 140 within fuel vapor purging system 171 during vacuum conditions will now be described. The vacuum conditions may include intake manifold vacuum conditions. For example, intake manifold vacuum conditions may be present during an engine idle condition, with manifold pressure below atmospheric pressure by a threshold amount. This vacuum in the intake system 23 may draw fuel vapor from the canister through conduits 150 and 151 into intake manifold 116, as represented by dashed line(s) 103 and 105. Further, at least a portion of the fuel vapors may flow from conduit 150 into ejector 140 via inlet 144 via dashed line(s) 103, 103*a*, and 103*b*. Upon entering the ejector via inlet 144, the fuel vapors may flow through nozzle 204 toward inlet 142. Specifically, the intake manifold vacuum causes the fuel vapors to flow through orifice 212. Because the diameter of the area within the nozzle gradually increases in a direction from inlet 144 towards inlet 142, the fuel vapors flowing through the nozzle in this direction diffuse, which raises the pressure of the fuel vapors. After passing through the nozzle, the fuel vapors exit ejector 140 through first inlet 142 and flow through outlet port 148 to intake passage 118 and then to intake manifold 116, indicated by dashed line 103*b*.

Next, the operation of ejector 140 within fuel vapor purging system 171 during boost conditions will be described. The boost conditions may include conditions during which the compressor is in operation. For example, the boost conditions may include one or more of a high engine load condition and a super-atmospheric intake condition, with intake manifold pressure greater than atmospheric pressure by a threshold amount. Additionally, boost conditions may include when boost pressure, measured in intake conduit 118 downstream of compressor 126, is greater than atmospheric pressure. Thus, the pressure of air in the intake conduit 118 downstream of compressor 126 is greater than the pressure of air in the intake conduit 118 upstream of compressor 126 during boost conditions (referred to herein as boosted engine operation).

Fresh air enters intake passage 118 at air filter 174. During boost conditions, compressor 126 pressurizes the air in intake passage 118, such that intake manifold pressure is positive. Pressure in intake passage 118 upstream of compressor 126 is lower than intake manifold pressure during operation of compressor 126, and this pressure differential induces a flow of fluid from intake conduit 118 through outlet port 148 and into ejector 140 via ejector inlet 142, indicated by arrow 103*e*. This fluid may include a mixture of air and fuel, in some examples. After the fluid flows into the ejector via the inlet 142, it flows through the converging orifice 212 in nozzle 204 in a direction from inlet 142 towards outlet 146. Because the diameter of the nozzle gradually decreases in a direction of this flow, a low pressure zone is created in a region of orifice 212 adjacent to suction inlet 144. The pressure in this low pressure zone may be lower than a pressure in duct 150. When present, this pressure differential provides a vacuum to conduit 150 to draw fuel vapor from canister 104, as indicated via dashed line(s) 103 and 103*a*. This pressure differential may further induce flow of fuel vapors from the fuel vapor canister, through the CPV, and into inlet 144 of ejector 140. Upon entering the ejector, the fuel vapors may be drawn along with the fluid from the intake manifold out of the ejector via outlet 146 and into intake 118 at a position upstream of compressor 126, as indicated via dashed lines 103*c* and 103*d*. Operation of compressor 126 then draws the fluid and fuel vapors from ejector 140 into intake passage 118 and through the compressor. After being compressed by compressor 126, the fluid and fuel vapors flow through charge air cooler 156, for delivery to intake manifold 116 via throttle 114.

Vehicle system 100 may further include a control system 160. Control system 160 is shown receiving information from a plurality of sensors 162 (various examples of which are described herein) and sending control signals to a plurality of actuators 164 (various examples of which are described herein). As one example, sensors 162 may include an exhaust gas sensor 125 (located in exhaust manifold 120) and various temperature and/or pressure sensors arranged in intake system 23. For example, a pressure or airflow sensor 115 in intake conduit 118 downstream of throttle 114, a pressure or air flow sensor 117 in intake conduit 118 between compressor 126 and throttle 114, and a pressure or air flow sensor 119 in intake conduit 118 upstream of compressor 126. In some examples, pressure sensor 119 may comprise a dedicated barometric pressure sensor. Other sensors such as additional pressure, temperature, air/fuel ratio, and composition sensors may be coupled to various locations in the vehicle system 100. As another example, actuators 164 may include fuel injectors 132, throttle 114, compressor 126, a fuel pump of pump system 130, etc. The control system 160 may include an electronic controller 166. The controller may receive input data from the various sensors, process the input data, and trigger the actuators in response to the processed input data based on instruction or code programmed therein corresponding to one or more routines.

Diagnostic tests may be periodically performed on the evaporative emissions control system 154 and fuel system 106 in order to indicate the presence or absence of undesired evaporative emissions. In one example, under boosted conditions, the higher pressure in intake conduit 118 downstream from compressor 126 directs flow through outlet port 148 into ejector 140 via inlet 142. The low pressure at inlet 144 draws fuel vapors from canister 104 through conduit 150 and CV 170 which is combined with the air from intake conduit 118 flowing through ejector 140 and exits ejector 140 via outlet 146. Pressure differentials within intake conduit 118 upstream at sensor 119 may be compared with measurements at sensors 117 and 115 to monitor function of purge system 171.

In another example, under boost conditions (e.g. intake manifold pressure greater than barometric pressure by a predetermined threshold), again the CVV 172 may be commanded closed, and the CPV 158 may be commanded open. By commanding closed the CVV 172 and commanding open the CPV 158 during boost conditions, the evaporative emissions control system 154 and fuel system 106 may be evacuated (as indicated via dashed lines 103) in order to ascertain the presence or absence of undesired evaporative emissions. As discussed above, pressure in the fuel system and evaporative emissions control system may be monitored via, for example, pressure sensor 107. If a threshold vacuum (e.g., negative pressure threshold with respect to atmospheric pressure) is reached during evacuating the evaporative emissions control system 154 and fuel system 106, an absence of gross undesired evaporative emissions may be indicated. Furthermore, if the threshold vacuum is reached, then it may be indicated that the ejector outlet 146 is not disconnected or substantially stuck closed. However, similar to that described above for the diagnostic test performed on the evaporative emissions control system 154 and fuel system 106 under natural aspiration conditions, a diagnostic test conducted during boost conditions where the threshold vacuum is not reached may not be able to discern whether inability to achieve the threshold vacuum is the result of a stuck closed outlet 146, or the presence of gross undesired evaporative emissions. As such, the inventors herein have developed systems and methods to address these issues.

In a case where ejector 140 becomes disconnected (e.g., uncoupled) from the AIS 173, as shown in FIG. 1B, e.g., outlet 146 is broken or no longer latched to (e.g., moves away from) conduit 152, the higher pressure in ejector 140, upstream of nozzle 204, and rigidity of housing 168, outlet 146 and evacuation port 145, results in evacuation port 145 pushing away from and disconnecting from protrusion 143. Thus, the evacuation port 145 is spaced away from the protrusion 143. In this way, the opening in evacuation port 145 is no longer sealed and the higher pressure upstream of nozzle 204 is dissipated by air exiting through evacuation port 145 as indicated by an arrow 103*f*. The flow through nozzle 204 is halted and the low pressure area at inlet 144 of ejector 140 is returned to ambient pressure, thereby eliminating the vacuum created in the ejector 140 at inlet 144 and stopping the flow (e.g., pulling) of vapors from canister 104 through conduit 150 into ejector 140. The stopping of the flow of vapors from the canister and into ejector 140 upon loss of vacuum prevents emission of fuel vapors to the atmosphere (via the disconnected outlet 146). Furthermore, the free flow of air from intake conduit 118 into inlet 142 and exiting through the disconnected evacuation port 145 of ejector 140 results in a loss of pressure in intake conduit 118 downstream of compressor 126, thus decreasing the pressure differential detected by control system 160 via sensors 119 and 117. In this manner, the fault (in the form of the disconnected outlet 146 from conduit 152) in the purge system 141 may be identified.

Turning now to FIGS. 2A-2B, a detailed view of a first embodiment of an ejector 200 contained within a rigid housing 201, which in one example may be ejector 140 in FIGS. 1A-1B, is depicted. While FIG. 2A shows an exterior view of ejector 200, FIG. 2B shows a cross-sectional view (showing an interior) of the ejector 200. As shown in FIGS. 2A-2B, ejector 200 includes a first inlet 202 adapted to connect and seal with a port in an engine intake of an air intake system (such as AIS 173 shown in FIGS. 1A-1B) arranged downstream of a compressor and within or upstream of an intake manifold, such as outlet port 148 in FIGS. 1A-1B. In one example, as shown in FIGS. 2A-2B, the first inlet 202 may seal within the port in the AIS via an o-ring 204 encircling the exterior surface (around a circumference) of first inlet 202, as seen in FIG. 2A. During boosted conditions, pressurized air flows from a compressor, such as compressor 126 in FIGS. 1A-1B, into ejector 200 via the first inlet 202. The direction of air flow into inlet 202 is given by an arrow 206*a* and is parallel to a central airflow passage 203 through ejector 200 (as shown in FIG. 2B). A second inlet 208 of ejector 200 is positioned downstream of (relative to flow during boost conditions) and perpendicular to first inlet 202. The second inlet 208 may also be adapted with an o-ring 210 encircling the exterior surface of the second inlet 208. In this way, via the o-ring 210 and/or another mating feature of second inlet 208, second inlet 208 is adapted to couple to a conduit of a fuel vapor recovery system, such as the fuel vapor recovery system 154 in FIG. 1A. During conditions where fuel vapors may flow from a fuel vapor canister, such fuel vapor canister 104 in FIG. 1A, and toward ejector 200, these fuel vapors may flow into second inlet 208 in a direction perpendicular to and towards the flow through central airflow passage 203, as indicated by an arrow 206*b*.

An evacuation port 212 of ejector 200 is positioned downstream of first inlet 202 and upstream of second inlet 208. The evacuation port 212 is arranged perpendicular to the first inlet 202 and the central airflow passage 203 and parallel to second inlet 208. Additionally, the evacuation port 212 extends rigidly outwards from the central airflow passage 203 on the opposite side of ejector 200 from second inlet 208, relative to a central passage axis 235 of central airflow passage 203. FIG. 2B depicts an o-ring 214 seated within the inner orifice (around the inner surface) of evacuation port 212. The evacuation port 212 may be shaped to couple with a protrusion extending from an outer wall of the AIS, upstream of the compressor, such as protrusion 143 shown in FIGS. 1A-1B. Thus, the o-ring 214 may be adapted to form a sealing contact with a closed end of the AIS protrusion. The direction of air flow through evacuation port 212 occurring during boost conditions when ejector 200 is disabled (e.g., the outlet 216 of ejector 200 is disconnected from the AIS, upstream of the compressor), as described above for ejector 140 in FIG. 1B, is indicated by arrow 206*c*. The flow of air through evacuation port 212 is perpendicular to the flow of air through central airflow passage 203 and parallel to and in the opposite direction from air flow through second inlet 208. This flow of pressurized (e.g., boosted) air exits through evacuation port 212 upon ejection of the protrusion and loss of the sealing contact between the protrusion and evacuation port 212.

An outlet 216 of ejector 200, is arranged at the furthest downstream end of ejector 200 and is, similar to evacuation port 212, also a rigid extension that is arranged perpendicular to first inlet 202, parallel to both evacuation port 212 and second inlet 208, and on the same side of ejector 200, relative to central passage axis 235, as evacuation port 212.

Air flow through outlet 216, indicated by an arrow 206*d*, is perpendicular to the flow through central airflow passage 203 and parallel with and in the same direction as flow through evacuation port 212. A length 224 of outlet 216, measured in a direction perpendicular to the central passage axis 235 of central airflow passage 203, is longer than a length 226 of evacuation port 212. The difference in lengths 224 and 226, in addition to the rigid connection between evacuation port 212 and outlet 216 to the housing 201, results in the disconnection between evacuation port 212 and the protrusion attached to the AIS when outlet 216 is detached from the intake conduit or stuck closed (for example, as shown in FIG. 1B). However, in alternate embodiments, the lengths of the evacuation port 212 and outlet 216 may different than shown in FIG. 2B. For example, in one example, these lengths may be the same. The lengths of the evacuation port 212 and the outlet 216 may depend on a length of the protrusion on the AIS (adapted to couple with evacuation port 212). In any case, the length between an outer wall of the AIS (which couples to the outlet 216 and the evacuation port 212 via the protrusion) and where the evacuation port 212 couples to the central airflow passage 203 may be the same as the length between the outer wall of the AIS and where the outlet 216 couples to the central airflow passage 203. In this way, when the outlet 216 becomes disconnected from the AIS, the evacuation port 212 may also uncouple from the protrusion of the AIS.

Outlet 216 includes a first mating feature, such as a quick connect fitting, adapted to connect outlet 216 to the AIS via a conduit, such as conduit 152 in FIGS. 1A-1B, within the inner surface of outlet 216. For example, a first end of the AIS conduit (which may be referred to as an inlet conduit of the AIS arranged upstream of the compressor and protrusion) may include a first quick connect fitting arranged on an outer surface of the AIS conduit, as shown in FIG. 1B, which includes a set of ball bearings, such as the ball bearings 176 in FIG. 1B. As seen in FIG. 2B, the inner surface of outlet 216 may be equipped with a second quick connect fitting 218 into which the first quick connect fitting attached to the AIS conduit may be mated. The second quick connect fitting 218 includes an insert 220 that forms an inner chamber within outlet 216 with a diameter that narrows in a direction opposite of the flow, as indicted by arrow 206*d*, through outlet 216. Insert 220 includes a set of tabs 222 wherein the top ends 221 of the tabs 222, e.g. the ends closest to the central airflow passage 203, may be pivoted away from or towards the inner walls of outlet 216 while the bottom ends 223 of the tabs 222 downstream of the pivotable ends, are fixed in place. In the absence of any applied pressure, the top ends 221 of the tabs 222 are positioned to be pivoted away from the inner walls of outlet 216. When the first quick connect fitting, attached to the AIS conduit, is inserted into the second quick connect fitting 218, the first quick connect fitting is adapted in length, as measured in a direction perpendicular to the central airflow passage 203, to slide into insert 220 until the ball bearings coupled to the first quick connect fitting pass the top ends 221 of the tabs 222. As the ball bearings slide past the tabs 222 in a direction opposite of the air flow, as indicated by arrow(s) 206*d*, the width of the ball bearings push the pivotable top ends 221 of tabs 222 towards the inner walls of outlet 216 until the ball bearings are upstream of the top ends 221 of tabs 222, wherein the pressure from the ball bearings pushing the top ends 221 towards the inner walls of outlet 216 is alleviated and as a result, the top ends 221 of tabs 222 pivot away from the inner walls of outlet 216. In this way, outlet 216 is secured to the conduit and AIS via the quick connect fittings adapted therein. To unlatch outlet 216 from the first quick connect fitting, an operator may push the end of insert 220 that extends beyond the end of outlet 216 in a direction opposite to the direction of flow through outlet 216 (given by arrow(s) 206*d*). Insert 220 interfaces with the bottom ends 223 of the tabs 222 wherein pressure applied to the bottom ends 223 by insert 220 in the aforementioned direction results in the top ends 221 of the tabs 222 pivoting towards the inner walls of outlet 216. In one example, insert 220 may be connected to the bottoms ends 223 of the tabs 222 by a hinged element such as a torsional spring. In this way, the pivoting of the tabs 222 triggered by pushing insert 220 allows the first quick connected to slide out of outlet 216. In an alternate embodiment, the outlet 216 may include a different type of first mating feature that is adapted to mate and couple with a corresponding second mating feature on the AIS conduit. The first mating feature may be included on an inner surface of the outlet 216 and be adapted to mate with the second mating feature arranged on an outer surface of the AIS conduit, so that the first mating feature is adapted to couple around and to the second mating feature. The first and second mating features may be various removable fasteners adapted to removably couple and mate with one another (e.g., having complementary shapes).

In one embodiment, quick connect fitting 218 may also include a valve 228 which may be a ball bearing that has a diameter wider than a top opening 225 of insert 220, e.g. the end of insert 220 closest to the central airflow passage 203, of quick connect fitting 218. The valve 228 is adapted to open, or shift into a position within quick connect fitting 218 where the diameter of insert 220 is wider than the diameter of valve 228, during conditions wherein air flow occurs through ejector 200 in the direction indicated by arrows 206*a* and 206*d*. When no air is flowing through ejector 200, the valve 228 remains in the closed position, e.g. in a position wherein the diameter of insert 220 is equal to the diameter of valve 228.

In another embodiment, quick connect fitting 218 may not have valve 228 and may, instead, include another type of valve that is adapted to remain in a closed position unless actuated by air flow to open. In yet another embodiment, quick connect fitting 218 may not include a valve and the inner passage of outlet 216 remains open regardless of air flow.

A nozzle (also referred to herein as a constriction) 230, e.g. a venturi nozzle, is arranged within the central airflow passage 203 of ejector 200, downstream of evacuation port 212 and upstream of second inlet 208. An upstream end of nozzle 230 has a first diameter 234 that is wider than a second diameter 232 at a downstream end of nozzle 230. The difference in diameters 234 and 232 provides a constriction in the flow through the central airflow passage 203. During boosted conditions, the pressurized air entering ejector 200 through first inlet 202 and towards second inlet 208 flows through the constriction provided by nozzle 230, resulting in a decrease in pressure in the area downstream of nozzle 230 adjacent to second inlet 208. This low pressure region creates a vacuum at second inlet 208, thereby sucking air and fuel vapors from a passage coupled to second inlet 208, the passage coupled to a fuel canister, such as fuel vapor canister 104 in FIG. 1A, into ejector 200 via second inlet 208. The fuel vapors and boosted air continue in the direction given by arrows 206*a* and 206*d* and exit through outlet 216 to the AIS.

In the event wherein ejector 200 becomes detached during boost conditions from the AIS at outlet 216, as shown by ejector 140 in FIG. 1B, evacuation port 212 is also disconnected from the protrusion attached to the exterior wall of the intake conduit of the AIS, resulting in a dissipation of pressure in ejector 200 upstream of nozzle 230 and loss of flow through nozzle 230. In this way, the formation of a low pressure area adjacent to second inlet 208 is reduced and/or stopped, thereby preventing the inflow of fuel vapors into the ejector and to the atmosphere (via the disconnected outlet 216).

In another example, wherein outlet 216 is blocked, e.g. valve 228 is stuck in a closed position, no flow is generated through the ejector, inhibiting the formation of a low pressure area adjacent to second inlet 208, thereby preventing the vacuum formation at the second inlet 208 and the flow of fuel vapors into the ejector 200. When ejector 200 is blocked at outlet 216, the lack of pressure differentials upstream and downstream of the compressor, may be detected by sensors positioned along the AIS and engine intake, such as sensors 119, 117, and 115 in FIGS. 1A-1B. In this way, a fault in the purge system may be identified.

FIGS. 1A-2B show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chambered, angled, or the like). Further, elements shown intersecting one another may be referred to as intersecting elements or intersecting one another, in at least one example. Further still, an element shown within another element or shown outside of another element may be referred as such, in one example.

Figure 3:
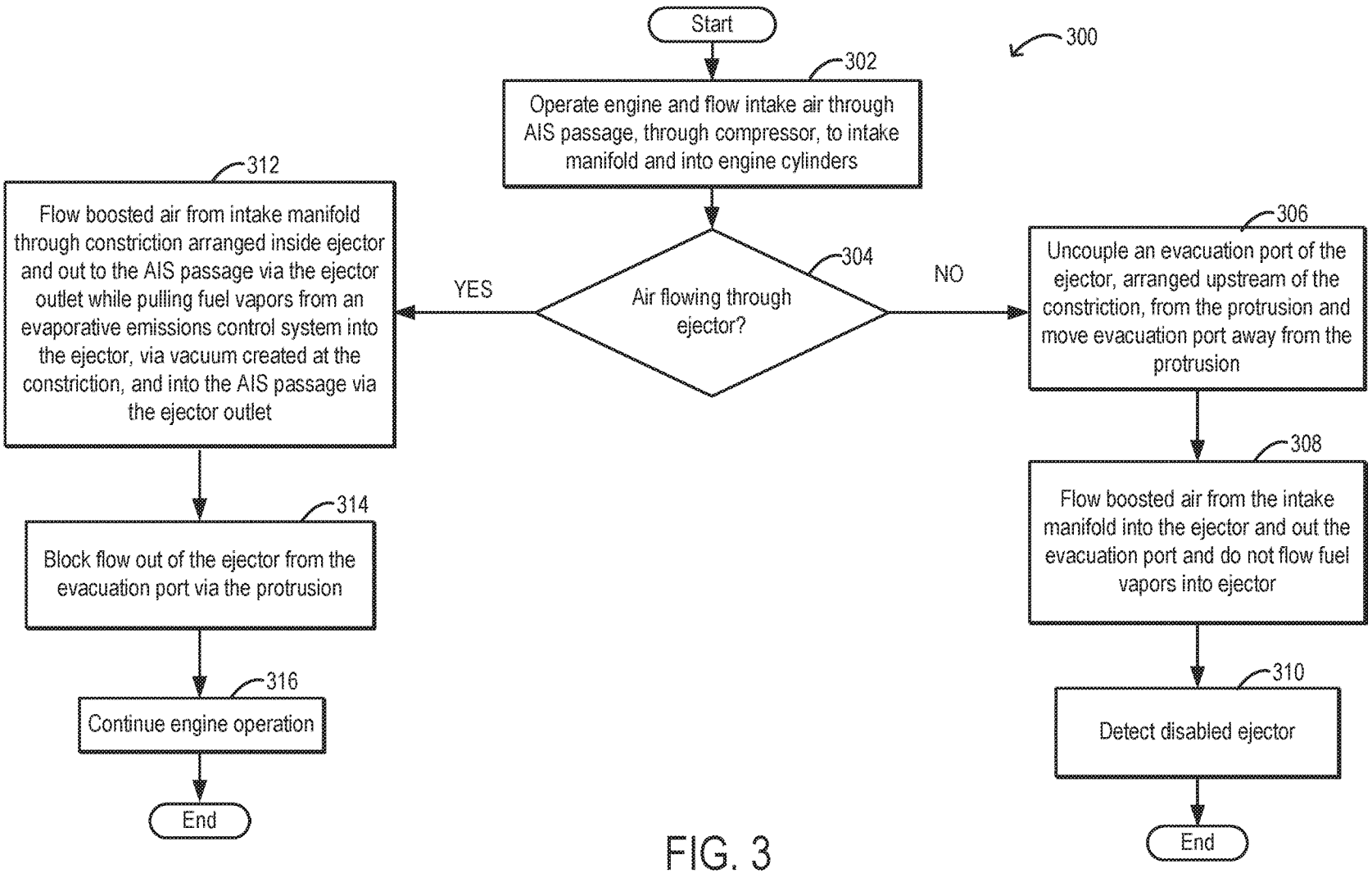
FIG. 3 shows a flow chart for operation of the dual path ejector system.

Turning to FIG. 3, a flow chart of a method 300 for operation of an ejector included in an engine system is shown during boosted conditions. Specifically, the ejector may be ejector 200 as shown in FIGS. 2A-2B. The ejector may be positioned between an evaporative emissions control system and an air induction system (AIS), such as ejector 140 shown in FIGS. 1A-1B. Instructions for carrying out portions of method 300 in FIG. 3 and the rest of the methods included herein may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below. However, portions of method 300 may also be passive operations of the ejector occurring during engine operation, but without input from the controller.

At 302, the method includes operating the engine and flowing intake air through the AIS passage (e.g., intake passage 118 shown in FIGS. 1A-1B), through the compressor, and into the intake manifold and engine cylinders. Operating the engine at 302 may include operating the compressor so that the engine is boosted (e.g., pressure of air downstream of the compressor is greater than atmospheric pressure). At 304, the method includes determining whether air is flowing through the ejector and out of the outlet flow port (e.g., outlet 216 shown in FIGS. 2A-2B and/or outlet 146 shown in FIGS. 1A-1B) into the inlet flow port of the AIS passage (e.g., conduit 152 shown in FIGS. 1A-1B). In one example, the method at 304 may be passive (not implemented by the controller) and the flow through the ejector may automatically change based on whether the outlet port of the ejector is coupled to or uncoupled from the inlet flow port of the AIS passage. In another example, the controller may determine whether air is flowing through the ejector from sensors positioned along the AIS and engine intake measuring pressure or flow differentials. During a condition where air is not flowing through the ejector such as, for example, if the outlet of the ejector is disconnected from the AIS passage, the mating connection, including a first mating feature arranged on an inner surface of the outlet and a second mating feature on an outer surface of an inlet flow port of the AIS, may be detached (e.g., uncoupled). Thus, the outlet of the ejector may be positioned away from the inlet flow port.

If the outlet of the ejector is connected to the inlet flow port of the AIS passage, method 300 continues to 312 in FIG. 3. At 312, the method includes flowing boosted air from the intake manifold through a constriction (e.g., nozzle 230 shown in FIG. 2B) arranged inside the ejector and out to the AIS passage via the outlet of the ejector while pulling fuel vapors from an evaporative emissions system into the ejector, via vacuum created at the construction, and into the AIS passage via the ejector outlet. As explained herein, the flow through the constriction creates a vacuum downstream of the constriction and the vacuum pulls fuel vapors from the evaporative emissions control system into the ejector and into the AIS passage via the outlet of the ejector. During the method at 312, the outlet port is connected to the inlet flow port of the AIS passage, which is arranged upstream of the compressor, via a mating connection including a first mating feature arranged on an inner surface of the outlet port and a second mating feature arranged on an outer surface of the inlet flow port, the first mating feature adapted to be removably coupled to the second mating feature. In one example, flowing boosted air from the intake manifold coupled to the AIS passage, through the constriction arranged inside the ejector at 312 includes flowing boosted air into the ejector from the intake manifold via a first inlet of the ejector (e.g., first inlet 202 shown in FIGS. 2A-2B) arranged upstream of the constriction and the evacuation port and pulling fuel vapors from the evaporative emissions system into the ejector includes pulling fuel vapors from an evaporative emissions systems passage coupled to a fuel vapor canister coupled to a fuel tank into the ejector via a second inlet of the ejector (e.g., second inlet 208 shown in FIGS. 2A-2B) arranged downstream of the constriction and upstream of the outlet port.

While the ejector outlet is coupled to the AIS passage, an evacuation port of the ejector arranged upstream of the constriction is sealingly coupled to a closed-end protrusion (e.g., protrusion 143 shown in FIGS. 1A-1B) extending from an outer wall of the AIS passage, upstream of the compressor and downstream of where the outlet port is connected to the AIS passage. Thus, the method proceeds from 312 to 314 where the method includes blocking flow out of the ejector from the evacuation port via the protrusion. The method then continues to 316 to continue current engine operation with the ejector being enabled (e.g., so that boosted air flow and fuel vapors continue flowing through the ejector and out the ejector to the AIS passage, upstream of the compressor, via the ejector outlet).

Returning to 304, if the outlet of the ejector is not connected to the AIS passage, the method continues to 306 to uncouple the evacuation port of the ejector, arranged upstream of the constriction of the ejector, from the protrusion and move the evacuation port away from the protrusion. At 308, the method includes flowing boosted air from the intake manifold into the ejector and out through the evacuation port and not flowing fuel vapors into the ejector. As such, fuel vapors are not drawn into the ejector from a fuel vapor canister. Further, when the outlet of the ejector is not connected to the AIS passage, the first mating feature of the outlet and the second mating feature of the inlet flow port are not coupled with one another and the outlet port is positioned away from the inlet flow port. The method continues to 310 where the method includes detecting the disconnected outlet of the ejector based on one or more pressures of the AIS. For example, a pressure in the AIS where the first inlet of the ejector couples to the AIS downstream of the compressor and a pressure in the AIS where the outlet of the ejector couples to the AIS upstream of the compressor may be measured by pressure sensors and the controller may determine that the outlet of the ejector is disconnected from the AIS in response to a difference between these two measured pressures decreasing while the engine is boosted. The disabling of the ejector may trigger the controller to set a diagnostic code, which may include an evaporative emission system purge flow performance during boost code. Then, when conditions for performing a diagnostic are met, the controller may initiate a diagnostic to monitor pressures in the AIS and ejector system while purging under boosted conditions to determine whether or not the ejector is connected and functioning properly. In another embodiment, upon detection that the ejector is disabled at 310, the controller may notify a user (e.g., vehicle operator) that the ejector needs to be serviced (e.g., reattached) or replaced.

In this way, an ejector coupled to an air induction system (AIS) and evaporative emissions system in an engine may be self-disabled to avoid leakage of fuel vapor to the atmosphere in the event that the ejector is disconnected from the AIS. As explained above, the ejector includes an inlet connected to an intake manifold of the engine and an evacuation port positioned upstream of a constriction, or nozzle, arranged within a central airflow passage of the ejector. The evacuation port is sealingly coupled to a closed-end protrusion connected to an outer wall of the AIS, upstream of a compressor, which blocks flow through the evacuation port. An upstream end of the nozzle is wider in diameter than a downstream end. Immediately downstream of the narrower end of the nozzle is a second inlet of the ejector, connected to the evaporative emissions system, and furthest downstream in the ejector is an outlet that is connected, via mated fittings, to the AIS, upstream of the compressor. During boosted engine conditions, if the outlet port of the ejector becomes detached from the AIS or is stuck closed, the pressurized air flowing into the ejector upstream of the constriction will cause the evacuation port to push away and separate from the protrusion and the boosted air will flow out of the evacuation port. The technical effect of the evacuation port ejecting the protrusion when the outlet becomes disconnected from the AIS or blocked is the dissipation of flow upstream of the constriction, preventing the formation of a low pressure area downstream of the constriction and adjacent to the inlet connected to the evaporative emissions control system. As a result, fuel vapors are not drawn into the ejector or emitted to the atmosphere through the disconnected outlet of the ejector. Furthermore, this self-disabling design allows the ejector to be positioned with the nozzle outside the AIS, thus circumventing limitations on engine packaging and resulting engine costs.

As one embodiment, a system includes: an air induction passage of an engine including an inlet flow port and an external protrusion having a closed end, each branching off a same side of the air induction passage; and an ejector, including: a constriction arranged between an outlet adapted to couple to the inlet flow port and an evacuation port adapted to couple to the protrusion; and first and second inlets positioned on either side of the constriction. In a first example of the system, the external protrusion is arranged outside of the air induction passage and coupled to an outer wall of the air induction passage. A second example of the system optionally includes the first example and further includes, wherein each of the outlet and evacuation port are rigid and arranged parallel with one another. A third example of the system optionally includes one or more of the first and second examples and further includes, wherein the first inlet is arranged perpendicular to each of the outlet and evacuation port and wherein the second inlet is arranged parallel to each of the outlet and evacuation port. A fourth example of the system optionally includes one or more of the first through third examples and further includes, wherein the constriction includes a wider end and a narrower, constricted end positioned downstream in the ejector from the wider end and wherein the first inlet is positioned upstream of the wider end and the second inlet is positioned downstream of the constricted end. A fifth example of the system optionally includes one or more of the first through fourth examples and further includes, wherein the evacuation port is positioned upstream of the wider end and the outlet is positioned downstream of the constricted end. A sixth example of the system optionally includes one or more of the first through fifth examples and further includes, wherein the ejector includes a central airflow passage in which the constriction is disposed, wherein the first inlet is arranged at a first end of the central airflow passage and the outlet is arranged at a second end of the central airflow passage, and wherein each of the outlet, second inlet, and evacuation port branch off the central airflow passage, where airflow through each of the outlet, second inlet, and evacuation port is perpendicular to airflow through the central airflow passage. A seventh example of the system optionally includes one or more of the first through sixth examples and further includes, wherein an o-ring is disposed within an interior of the evacuation port and adapted to seal around and against an outer wall of the external protrusion. An eighth example of the system optionally includes one or more of the first through seventh examples and further includes, wherein the outlet includes an end connector having an inner mating surface adapted to removably couple with a corresponding outer mating surface on an end of the inlet flow port of the air induction passage.

An ninth example of the system optionally includes one or more of the first through eighth examples and further includes, wherein each of the inlet flow port and external protrusion are arranged upstream of a compressor disposed in the air induction passage, wherein the first inlet is adapted to couple to an intake manifold of the engine, and wherein the second inlet is adapted to couple to an evaporative emissions passage coupled to a fuel vapor canister coupled to a fuel tank.

As another embodiment, a method includes: during a first condition, when an outlet port of an ejector is connected to an air induction system passage, upstream of a compressor, flowing boosted air from an intake manifold coupled to the AIS passage, through a constriction arranged inside the ejector and out to the AIS passage via the outlet port while pulling fuel vapors from an evaporative emissions system into the ejector, via vacuum created at the constriction, and into the AIS passage via the outlet port; and during a second condition, when the outlet port is disconnected from the AIS passage, upstream of the compressor, flowing boosted air from the intake manifold, into the ejector and out an evacuation port of the ejector arranged upstream of the constriction and not flowing fuel vapors into the ejector. In a first example of the method, during the first condition, the evacuation port is sealingly coupled to a closed-end protrusion extending from an outer wall of the AIS passage, upstream of the compressor and downstream of where the outlet port is connected to the AIS passage and further comprising, during the first condition, blocking flow out of the ejector from the evacuation port via the protrusion. A second example of the method optionally includes the first example, and further includes, during the second condition, uncoupling the evacuation port from the protrusion and moving the evacuation port away from the protrusion. A third example of the method optionally includes one or more of the first and second examples, and further includes, wherein, during the first condition, the outlet port is connected to an inlet flow port of the AIS passage arranged upstream of the compressor via a mating connection including a first mating feature arranged on an inner surface of the outlet port and a second mating feature arranged on an outer surface of the inlet flow port, the first mating feature adapted to be removably coupled to the second mating feature. A fourth example of the method optionally includes one or more of the first through third examples, and further includes, wherein, during the second condition, the first mating feature and second mating feature are not coupled with one another and the outlet port is positioned away from the inlet flow port. A fifth example of the method optionally includes one or more of the first through fourth examples, and further includes, wherein flowing boosted air from the intake manifold coupled to the AIS passage, through the constriction arranged inside the ejector includes flowing boosted air into the ejector from the intake manifold via a first inlet of the ejector arranged upstream of the constriction and the evacuation port and wherein pulling fuel vapors from the evaporative emissions system into the ejector includes pulling fuel vapors from an evaporative emissions systems passage coupled to a fuel vapor canister coupled to a fuel tank into the ejector via a second inlet of the ejector arranged downstream of the constriction and upstream of the outlet port.

In yet another embodiment, a system includes: an air induction system including an intake passage coupled to an intake manifold and a compressor disposed in the intake passage, upstream of the intake manifold, the intake passage including an intake flow port and an external protrusion having a closed end, each arranged upstream of the compressor and extending outward in a same direction from the intake passage; an evaporative emissions system including an evaporative emissions passage coupled to a fuel vapor canister, the fuel vapor canister coupled to a fuel tank; and an ejector, including: a constriction arranged in a flow passage of the ejector; an outlet arranged downstream from the constriction and adapted to connect to the intake flow port; an evacuation port arranged upstream of the constriction and adapted to couple to the external protrusion; a first inlet coupled to the intake manifold and arranged upstream of the constriction; and a second inlet coupled to the evaporative emissions passage and arranged downstream of the constriction. In a first example of the system, the outlet and the evacuation port are each rigid, wherein a central, passage axis of each of the outlet and evacuation port are arranged parallel to one another, and wherein each of the outlet and evacuation port extend outward, toward the intake passage, from the flow passage of the ejector. A second example of the system optionally includes the first example, and further includes, wherein the external protrusion is arranged outside of the intake passage and extends from an outer wall of the intake passage toward the ejector. A third example of the system optionally includes one or more of the first and second examples, and further includes, wherein the first inlet is fixedly coupled to the intake manifold and wherein the outlet is coupled to the intake port via a removable, quick connect connection including a first mating feature on an inner surface of the outlet that is removably coupled around a second mating feature on an outer surface of the intake flow port.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

an air induction passage of an engine including an inlet flow port and an external protrusion having a closed end, each branching off a same side of the air induction passage; and an ejector, including:

a constriction arranged between an outlet adapted to couple to the inlet flow port and an evacuation port adapted to couple to the protrusion; and first and second inlets positioned on either side of the constriction.

2. The system of claim 1, wherein the external protrusion is arranged outside of the air induction passage and coupled to an outer wall of the air induction passage.

3. The system of claim 1, wherein each of the outlet and evacuation port are rigid and arranged parallel with one another.

4. The system of claim 3, wherein the first inlet is arranged perpendicular to each of the outlet and evacuation port and wherein the second inlet is arranged parallel to each of the outlet and evacuation port.

5. The system of claim 1, wherein the constriction includes a wider end and a narrower, constricted end positioned downstream in the ejector from the wider end and wherein the first inlet is positioned upstream of the wider end and the second inlet is positioned downstream of the constricted end.

6. The system of claim 5, wherein the evacuation port is positioned upstream of the wider end and the outlet is positioned downstream of the constricted end.

7. The system of claim 1, wherein the ejector includes a central airflow passage in which the constriction is disposed, wherein the first inlet is arranged at a first end of the central airflow passage and the outlet is arranged at a second end of the central airflow passage, and wherein each of the outlet, second inlet, and evacuation port branch off the central airflow passage, where airflow through each of the outlet, second inlet, and evacuation port is perpendicular to airflow through the central airflow passage.

8. The system of claim 1, wherein an o-ring is disposed within an interior of the evacuation port and adapted to seal around and against an outer wall of the external protrusion.

9. The system of claim 1, wherein the outlet includes an end connector having an inner mating surface adapted to removably couple with a corresponding outer mating surface on an end of the inlet flow port of the air induction passage.

10. The system of claim 1, wherein each of the inlet flow port and external protrusion are arranged upstream of a compressor disposed in the air induction passage, wherein the first inlet is adapted to couple to an intake manifold of the engine, and wherein the second inlet is adapted to couple to an evaporative emissions passage coupled to a fuel vapor canister coupled to a fuel tank.

11. A method, comprising:

during a first condition, when an outlet port of an ejector is connected to an air induction system passage, upstream of a compressor, flowing boosted air from an intake manifold coupled to the AIS passage, through a constriction arranged inside the ejector and out to the AIS passage via the outlet port while pulling fuel vapors from an evaporative emissions system into the ejector, via vacuum created at the constriction, and into the AIS passage via the outlet port; and during a second condition, when the outlet port is disconnected from the AIS passage, upstream of the compressor, flowing boosted air from the intake manifold, into the ejector and out an evacuation port of the ejector arranged upstream of the constriction and not flowing fuel vapors into the ejector.

12. The method of claim 11, wherein, during the first condition, the evacuation port is sealingly coupled to a closed-end protrusion extending from an outer wall of the AIS passage, upstream of the compressor and downstream of where the outlet port is connected to the AIS passage and further comprising, during the first condition, blocking flow out of the ejector from the evacuation port via the protrusion.

13. The method of claim 12, further comprising, during the second condition, uncoupling the evacuation port from the protrusion and moving the evacuation port away from the protrusion.

14. The method of claim 11, wherein, during the first condition, the outlet port is connected to an inlet flow port of the AIS passage arranged upstream of the compressor via a mating connection including a first mating feature arranged on an inner surface of the outlet port and a second mating feature arranged on an outer surface of the inlet flow port, the first mating feature adapted to be removably coupled to the second mating feature.

15. The method of claim 14, wherein, during the second condition, the first mating feature and second mating feature are not coupled with one another and the outlet port is positioned away from the inlet flow port.

16. The method of claim 11, wherein flowing boosted air from the intake manifold coupled to the AIS passage, through the constriction arranged inside the ejector includes flowing boosted air into the ejector from the intake manifold via a first inlet of the ejector arranged upstream of the constriction and the evacuation port and wherein pulling fuel vapors from the evaporative emissions system into the ejector includes pulling fuel vapors from an evaporative emissions systems passage coupled to a fuel vapor canister coupled to a fuel tank into the ejector via a second inlet of the ejector arranged downstream of the constriction and upstream of the outlet port.

17. A system, comprising:

an air induction system including an intake passage coupled to an intake manifold and a compressor disposed in the intake passage, upstream of the intake manifold, the intake passage including an intake flow port and an external protrusion having a closed end, each arranged upstream of the compressor and extending outward in a same direction from the intake passage;

an evaporative emissions system including an evaporative emissions passage coupled to a fuel vapor canister, the fuel vapor canister coupled to a fuel tank; and an ejector, including:

a constriction arranged in a flow passage of the ejector;

an outlet arranged downstream from the constriction and adapted to connect to the intake flow port;

an evacuation port arranged upstream of the constriction and adapted to couple to the external protrusion;

a first inlet coupled to the intake manifold and arranged upstream of the constriction; and a second inlet coupled to the evaporative emissions passage and arranged downstream of the constriction.

18. The system of claim 17, wherein the outlet and the evacuation port are each rigid, wherein a central, passage axis of each of the outlet and evacuation port are arranged parallel to one another, and wherein each of the outlet and evacuation port extend outward, toward the intake passage, from the flow passage of the ejector.

19. The system of claim 17, wherein the external protrusion is arranged outside of the intake passage and extends from an outer wall of the intake passage toward the ejector.

20. The system of claim 17, wherein the first inlet is fixedly coupled to the intake manifold and wherein the outlet is coupled to the intake port via a removable, quick connect connection including a first mating feature on an inner surface of the outlet that is removably coupled around a second mating feature on an outer surface of the intake flow port.

* * * * *